United States Patent [19]

Wright

[11] 4,280,282

[45] Jul. 28, 1981

[54] TEMPLATE FOR STAIRWAY CONSTRUCTION AND THE LIKE

[75] Inventor: Patrick Wright, Albuquerque, N. Mex.

[73] Assignee: PAJ Corporation, N. Mex.

[21] Appl. No.: 88,960

[22] Filed: Oct. 29, 1979

Related U.S. Application Data

[63] Continuation-in-part of Ser. No. 951,347, Oct. 16, 1978, abandoned.

[51] Int. Cl.[3] ..... B43L 13/00
[52] U.S. Cl. ..... 33/427
[58] Field of Search ..... 33/418–421, 33/427, 416, 417, 464, 471

[56] References Cited

U.S. PATENT DOCUMENTS

| | | | |
|---|---|---|---|
| 1,770,304 | 7/1930 | Ferris | 33/421 |
| 2,499,721 | 3/1950 | Cassity | 33/421 |
| 4,098,160 | 7/1978 | Weil | 33/427 X |

FOREIGN PATENT DOCUMENTS

| | | | |
|---|---|---|---|
| 2244109 | 3/1974 | Fed. Rep. of Germany | 33/427 |

*Primary Examiner*—Charles E. Phillips
*Attorney, Agent, or Firm*—Garrettson Ellis

[57] ABSTRACT

A template for measuring and scribing tread and riser lines for the construction of a stairway, or similar purposes, which comprises: a plate member defining first and second straight edges which, in turn, define a square corner. First and second movable stop means are respectively carried by the first and second straight edges. The second edge is defined by a separate portion of the plate member carried by it and movable along a path of travel parallel to the second edge. Fulcrum arm means are pivotally attached to both the separate portion and the rest of the plate member, so that pivoting of the fulcrum arm means moves the separate portion and second stop means to predetermined positions along the path of travel. Accordingly, the distances between the respective stop means along the straight edges from the square corner may be adjusted, and the resulting adjusted template may be used to scribe tread and riser lines of predetermined lengths in a manner which is substantially more convenient than prior art techniques.

5 Claims, 2 Drawing Figures

FIG. 1
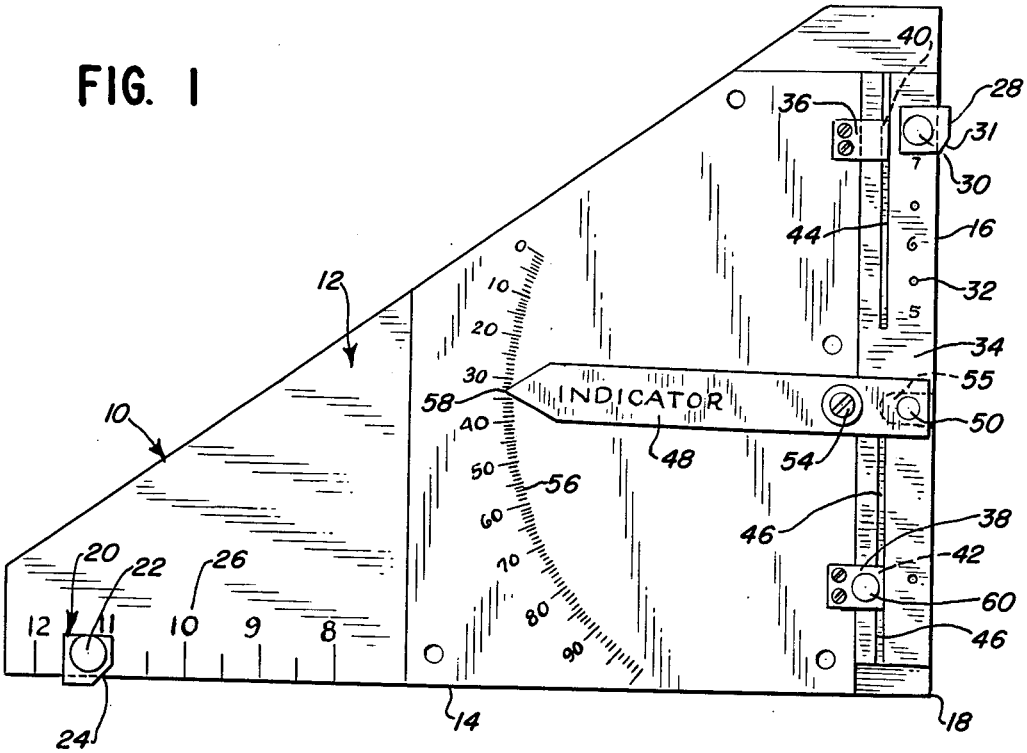
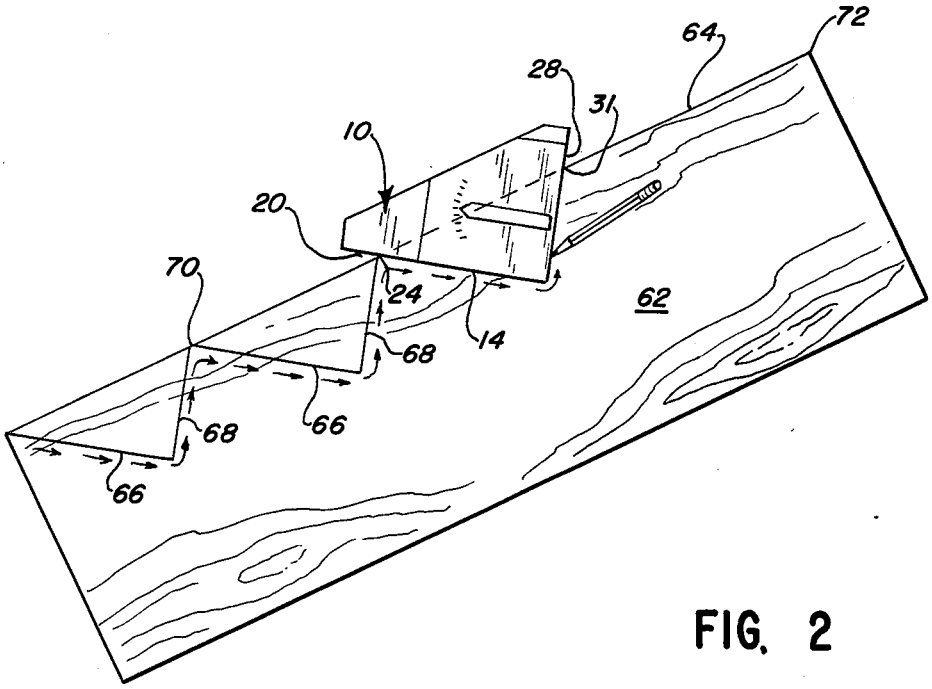
FIG. 2

TEMPLATE FOR STAIRWAY CONSTRUCTION AND THE LIKE

CROSS-REFERENCE TO RELATED APPLICATION

This application is a continuation-in-part of U.S. application Ser. No. 951,347, filed Oct. 16, 1978 now abandoned.

BACKGROUND OF THE INVENTION

In the construction of a stairway, one of the first things which must be done is to determine the pattern and dimensions of the threads and risers. This, of course, is a function of the total horizontal run and vertical rise of the stairway, with the width of the tread of each stair being normally, for example, 10 inches. These dimensions are, of course, highly variable, depending upon the particular construction project. For example, if the total rise of the stairway is 87 inches, it would be advisable to provide 12 risers in which the height of each riser is 7.25 inches. In the instance that a horizontal run of 110 inches is required, the number of treads present may be 11, and their width can be 10 inches.

In the prior art, this calculation is often arrived at experimentally by scribing various patterns of the risers and treads, frequently with much erasing and reworking, until a uniform pattern which fits the specific situaton is arrived at.

In accordance with this invention, a template is provided for simplifying the scribing of the tread and riser lines on the side boards for the construction of a stairway, or similar purpose. After the desired dimensions for the tread and riser are calculated, the template may be set with the desired dimensions. The template may then be placed along the edge of the pieces of plywood which will define the sides of the stairway. Then the respective tread and riser lines will be sequentially scribed along the square edges of the template, simply moving the template along the edge of the plywood and scribing the various tread and riser lines, to the completion of the project, without any need to measure distances along a conventional square or the like.

Furthermore, the accuracy of the template of this invention can be very high, so that, with proper calculation, the scribed tread and riser lines will be placed evenly and in their proper places along the side supports of the stair, without the need for "fudging" the results to fit the various tread and riser lines in. The side supports are then cut along the tread and riser lines, permitting attachment of the treads and risers.

The result of this is a uniform stairway, which simplifies its construction and provides higher quality work.

DESCRIPTION OF THE INVENTION

In accordance with this invention, a template is provided for measuring and scribing tread and riser lines for the construction of a stairway. The template comprises a plate member defining first and second straight edges which, in turn, define a square corner.

First movable stop means are carried by the plate member on the first edge, while second movable stop means are carried by the plate member on the second edge. The second edge is defined by a separate portion of the plate member, which is carried by the plate member and movable along a path of travel parallel to the second edge.

Fulcrum arm means are pivotally attached to both the separate portion and the rest of the plate member. As a result, pivoting of the fulcrum arm means causes the movement of the separate portion and the second stop means carried on it to predetermined positions along the path of travel, whereby the distance between the second stop means and the square corner may be adjusted. The first stop means is also movably adjustable for a similar purpose. The resulting adjusted template may be used to scribe tread and riser lines of predetermined lengths.

As a result of this, a stairway of properly spaced, equal treads and risers may be easily built.

In the drawings,

FIG. 1 is an elevational view of the template of this invention.

FIG. 2 is an elevational view of the template of this invention, in the position of use for scribing uniform tread and riser lines on a piece of building material such as plywood, in the construction of a stairway.

Referring to the drawings, the template 10 of this invention for measuring and scribing tread and riser lines on a stairway is seen to comprise a plate member 12, which may be made of metal, plastic or the like. Plate member 12 defines a first straight edge 14 and a second straight edge 16, which define a square corner 18 where they intersect.

First movable stop means 20 is carried by the plate member on the first edge. Stop means 20 is adjustably movable along the edge 14, being secured thereto by a thumb screw 22. Also, first stop means 20 defines a bevelled edge 24, which defines an obtuse angle to edge 14, preferably of about 130° to 140°, and specifically on the order of 145°.

Scale 26 is inscribed upon the template adjacent first edge 14, and is an indication of distance from square corner 18, with the scale extending in this embodiment from 8 to 12 inches, to serve as an adjustment means for positioning the first stop means by the simple expedient of loosening nut 22, positioning the stop means 20, and retightening nut 22 on the plate member 12.

Second movable stop means 28 is carried on the template at the second straight edge 16. Stop member 28 also carries an attachment nut 30 which fits into specific threaded holes 32, which may be spaced apart at equal intervals, for example, one inch or one centimeter as may be desired. In this embodiment, inches are used. Accordingly, the positioning of second stop member 28 is intended to be at any of several discreet specific positions.

Stop member 28 also defines a bevelled edge 31 which is generally parallel to bevelled edge 24, and is in a similar obtuse angle relationship to edge 16 as the relationship between edges 14 and 24.

A separate portion 34 of the plate member is provided, being carried on the plate member and held by retainers 36, 38 which each define a lip 40, 42 which extends respectively into channels 44, 46 of portion 34, for retention of portion 34 on the rest of the plate member.

The second straight edge 16 is defined by the separate portion 34, which is movable along a path of travel parallel to the second edge 16 in sliding relation to the rest of plate member 12.

Fulcrum or indicator arm 48 is provided, being pivotally attached both at pivot 50, which is attached to the separate portion 34, and pivot 54, which is attached to the main body of plate member 12. However, pivot 50 is movable in a horizontal slot 55 in separate portion 34 underneath indicator arm 48, to permit motion of portion 34. Accordingly, as the fulcrum or indicator arm 48 is pivoted, the separate portion 34 slides upwardly or downwardly along its path of travel, which is parallel to second edge 16. Second stop member 28, which is carried by separate portion 34, moves with the separate portion.

As a result of this, the position of the second stop member 28 will be governed by the position of indicator arm 48, so that a fine adjustment in the position of second stop member 28 with respect to corner 18 can be achieved thereby, with the gross positioning being controlled by the particular threaded hole 32 through which the thumb screw 30 of the second stop member 28 is installed.

A numerical scale 56 is provided, and the end 58 of indicator arm 48 is pointed and adapted to sweep across the numerical scale for a precise readout of the position of the indicator or fulcrum arm 48. In the particular embodiment shown, the threaded holes 32 are placed an inch apart, and the respective pivots 50, 54 are so positioned that the curved numerical scale provides a readout to the nearest 1/100 inch in the positioning of second stop member. For example, in the positions illustrated in FIG. 1, second stop member 28 is positioned in a threaded hole numbered 7, indicating a normal spacing of 7 inches from the square corner 18. The indicator or fulcrum arm 48 is positioned at 33, at which point the actual position of the inner portion of bevelled edge 31 is exactly 7.33 inches from square corner 18.

Retention member 38 carries another thumb screw 60 to lock separate portion 34 into any desired position.

Referring to FIG. 2, once the desired width of each tread and riser on the specific stairway to be built is determined, the tread length is set by proper adjustment of first stop member 20, and the riser height is adjusted by the appropriate placement of second stop member 28 in the desired threaded hole 32, which represents the distance in inches, with the added fractional distance of the riser height being set by appropriate positioning of indicator or fulcrum arm 48.

All of the thumb screws on the template are locked, and the template may then be used as seen in FIG. 2 to scribe the thread and riser lines on a piece of construction material 62 of the desired length to make the sides of the stairway. As can be seen in FIG. 2, bevelled edges 24, 31 are positioned against edge 64 of the construction material 62. Thereafter, beginning at one corner of the construction material 62, a tread line 66 may be scribed with a sharp pencil by tracing along edge 14 from stop member 20 to square corner 18. Without moving the template, the riser line 68 is scribed from stop member 28 to square corner 18.

Thereafter, the template is moved so that the inner portion of bevelled edge 24 overlies point 70 where the scribe line 68 intersects edge 64, and another pair of tread and riser lines 66, 68 are scribed. This process is then continued until the end of the building material is reached.

With proper calculation, the last scribing of a riser line 68 will terminate at corner 72 of the building material 62, showing that a precisely uniform pattern of treads and risers has been scribed. Thereafter, building material 62 may be cut along the respective lines 66, 68 to provide for the stairway.

As indicated, the template of this invention may be adjusted in a myriad of ways to scribe a wide variety of different tread and riser lines, or other square-cornered lines of repeating sequence for other uses, as may be desired. It is also contemplated that a metric version of the template of this invention may be easily manufactured by simple adjustment of dimensions.

The above has been offered for illustrative purposes only, and is not intended to limit the invention of this application, which is as defined in the claims below.

That which is claimed is:

1. A template for measuring and scribing tread and riser lines for the construction of a stairway, which comprises: a plate member defining first and second straight edges defining a square corner, first movable stop means carried by said plate member on said first edge, and second movable stop means carried by said plate member on said second edge, said second edge being defined by a separate portion of said plate member carried by said plate member and movable along a path of travel parallel to said second edge; and fulcrum arm means pivotally attached to both said separate portion and the rest of the plate member, whereby pivoting of said fulcrum arm means moves said separate portion and second stop means to predetermined positions along said path of travel, whereby the distances between the respective stop means along the straight edges from said square corner may be adjusted, and the resulting adjusted template may be used to scribe a tread and riser lines of predetermined length.

2. The template of claim 1 in which each movable stop means each define a bevelled edge, each of said bevelled edges defining an angle of essentially 130° to 140° with the respective straight edge associated with said stop means, whereby said template may be placed to overlie a piece of building material from which the side pieces of a stairway is to be cut, and the respective bevelled edges of the stop means may press against an edge of said building material with said square corner and first and second edges overlying said building material for scribing of said lines.

3. The template of claim 2 in which said fulcrum arm means is associated with a numerical scale on said plate, whereby the position of said fulcrum arm means indicates on said numerical scale a numbered position of said second stop means along said path of travel.

4. The template of claim 3 in which clamp means are carried by said plate member to releasably lock the removable separate portion of the plate member into a fixed predetermined position along the path of travel.

5. The template of claim 4 in which a numerical scale is provided along said first straight edge, whereby the first movable stop means may be positioned in a predetermined manner on said numerical scale.

* * * * *